US006044580A

United States Patent [19]

Gussalli Beretta

[11] Patent Number: 6,044,580

[45] Date of Patent: Apr. 4, 2000

[54] SEMIAUTOMATIC RIFLE WITH LATERAL FEEDING MECHANISM AND EJECTION FROM BELOW

[75] Inventor: Ugo Gussalli Beretta, Brescia, Italy

[73] Assignee: Fabbrica D Armi P. Beretta S.p.A., Italy

[21] Appl. No.: 09/094,709

[22] Filed: Jun. 15, 1998

[30] Foreign Application Priority Data

Jul. 8, 1997 [IT] Italy ..... BS97A0064

[51] Int. Cl.[7] ..... F41A 3/00; F41A 9/00; F41A 9/61; F41C 7/00

[52] U.S. Cl. ..... 42/17; 89/33.01

[58] Field of Search ..... 42/17, 20, 21, 42/44, 45, 40, 41, 75.02, 75.04; 89/33.1, 33.01–33.03

[56] References Cited

U.S. PATENT DOCUMENTS

| | | | |
|---|---|---|---|
| 273,131 | 2/1883 | Nemetz | 42/17 |
| 1,905,922 | 4/1933 | Loomis | 42/17 |
| 2,024,125 | 12/1935 | Bochnak | 89/9 |
| 2,586,509 | 2/1952 | Browning | 42/17 |
| 2,626,475 | 1/1953 | Browning | 42/17 |
| 2,945,423 | 7/1960 | Allyn | 89/199 |
| 3,035,495 | 5/1962 | Stoner | 89/33.2 |
| 3,058,399 | 10/1962 | Allyn | 89/184 |
| 3,540,345 | 11/1970 | Wolfe | 89/13.05 |
| 3,631,621 | 1/1972 | Tito | 42/17 |
| 3,919,800 | 11/1975 | Browning | 42/17 |
| 3,996,685 | 12/1976 | Bauman et al. | 42/17 |

*Primary Examiner*—Michael J. Carone
*Assistant Examiner*—Fredrick T. French, III
*Attorney, Agent, or Firm*—McGlew and Tuttle, P.C.

[57] ABSTRACT

A semiautomatic sports rifle or shotgun having a smooth or rifled bore. A casing (20) has a lateral opening (27) for introducing cartridges from one side of the casing and a lower opening (28) for ejecting the case (25') of each cartridge fired from below. At the level of the lateral opening (27) is mounted a rotating lateral feeding means (29), which is able to receive and to hold a second cartridge (26) during the firing of a first cartridge (25) and to introduce the second cartridge automatically into the gun with the aid of the breechblock (22) after the firing of the first cartridge (25) and the ejection of its empty case.

17 Claims, 9 Drawing Sheets

SEMIAUTOMATIC RIFLE WITH LATERAL FEEDING MECHANISM AND EJECTION FROM BELOW

FIELD OF THE INVENTION

The present invention pertains to semiautomatic sports rifles and shotguns with a smooth and/or rifled bore, and it pertains specifically to the feeding of the cartridges to be fired and to the ejection of the fired cartridge case in such rifles.

BACKGROUND OF THE INVENTION

A semiautomatic rifle, which has a pivoting, opening/closing barrel and in which are generically provided a cartridge feeding means on one side and a means for ejecting a fired cartridge case from below, was described in a contemporary patent application of the same applicant. Besides advantages in terms of safety and use practicality, such a semiautomatic rifle has the significant feature of being ambidextrous thanks to the ejection from below, which does not influence the right and left raising of the gun.

SUMMARY AND OBJECTS OF THE INVENTION

The present invention applies to a semiautomatic rifle and provides specifically a mechanism for the lateral feeding of cartridges to be fired and a means for ejecting the fired cartridge case from below.

According to the invention, a semiautomatic sports rifle or shotgun is provided having a smooth or rifled bore. A pivot/casing is connected to a barrel. The barrel has a cartridge chamber. A breechblock unit is provided which can be moved in the casing between an advanced position and a stopped position, i.e., positions of closing and of opening of the cartridge chamber, respectively. A triggering device is provided for controlling the firing, and in which the rifle can be loaded with a first cartridge, which can be inserted manually into the cartridge chamber, and a second cartridge, which can be automatically fed in after the firing of the first cartridge. The casing has a lateral opening for introducing the cartridges on one side of the casing and a lower opening for ejecting from below the case of each cartridge fired. At the level of the lateral opening of the casing there is mounted a rotating lateral feeding means which is able to receive and to hold the second cartridge during the firing of the first cartridge and to introduce the second cartridge into the gun automatically with the aid of the breechblock unit after the firing of the first cartridge and the ejection of its empty case through the lower opening and following the backwards movement of the breechblock.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
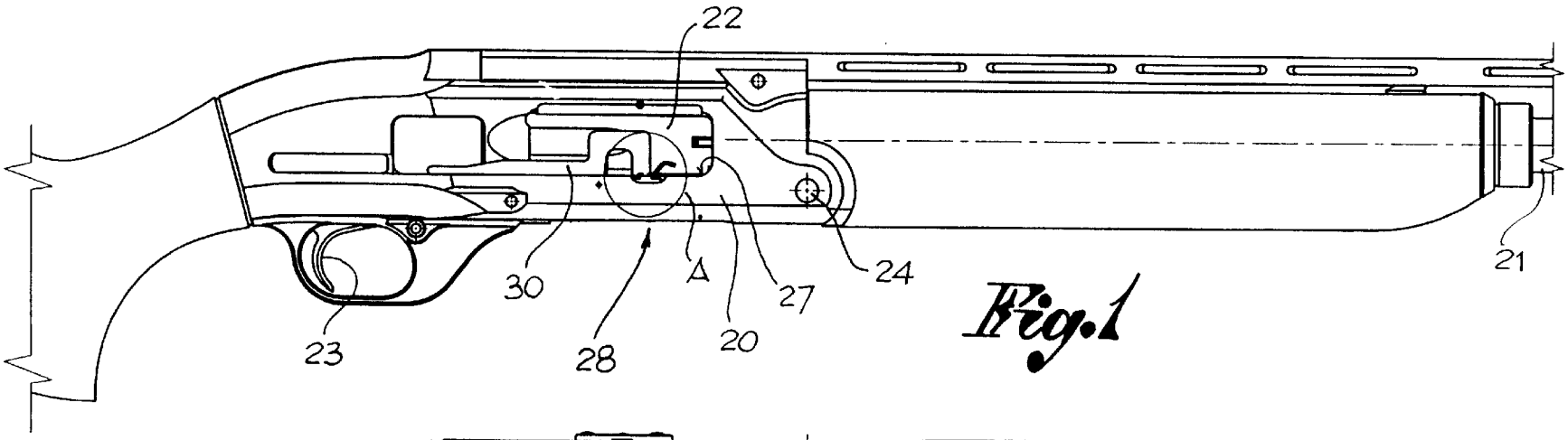
FIG. 1 is a lateral view of parts of a rifle according to the present invention.
Figure 2:
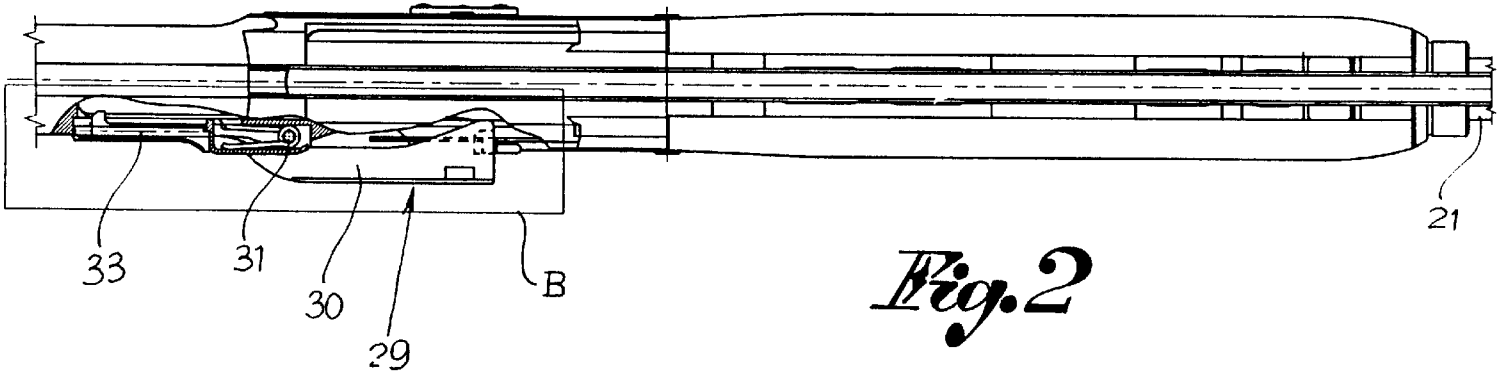
FIG. 2 is a top view of parts of a rifle according to the present invention.

Referring to the drawings in particular, the rifle shown comprises, a pivot casing (casing or a pivot) 20, a barrel 21 with a cartridge chamber 21', a breechblock unit 22, and a triggering device (which is itself known), of which only the trigger 23 is shown.

The barrel 21 is connected to the casing 20 with a pin 24, which forms an axis of rotation of the barrel between a closed position and a pivoted, opened position.

The breechblock carriage 22 is guided longitudinally in the casing 20 and can be moved between a closed and an opened position, i.e., a position advanced towards the barrel and a stopped position, respectively, to which correspond the insertion of a cartridge to be fired in the chamber 21' and the removal from the said chamber of a fired cartridge case. For the removal, the breechblock unit 22 is provided with a removal means 22', which is intended to hook onto the base of the cartridge case so as to drag this case backwards when the breechblock stops.

The triggering device in the casing does not need a specific description.

The rifle is able to be fed with and to fire in succession two cartridges, which are indicated as 25 and 26 in the drawings, and which will be referred to below as the first cartridge 25 and the second cartridge 26, respectively. The case of a (first) fired cartridge is indicated as 25'.

According to the present invention, a lateral opening 27 for the feeding of the cartridges 25, 26 to be fired and a central lower opening 28 for the exit of the case 25' of a fired cartridge are provided in the casing 20 of the rifle.

The first cartridge 25 is inserted manually directly into the gun through the lateral opening 27 when the breechblock unit has stopped, and it is inserted at the bottom into the cartridge, chamber 21' by means of the breechblock unit when it has advanced.

On the side of the casing 20, at the level of the lateral opening 27, is provided a feeding means 29, which is intended to receive the second cartridge 26 and to feed it automatically after the firing of the first cartridge 25 and the removal of its case 25'.

The feeding means 29 is in the form of a rotating spoon element, which in its rear part is mounted on a pin 31 rotating with the vertical axis. Thus, the spoon 30 is turned from the rear forward and can rotate from side to side from a starting position outside the casing, in parallel with same, to an internal feed position in which it is turned diagonally within the casing towards the cartridge chamber through the lateral opening 27.

The spoon 30 is configured to receive and to hold the second cartridge 26 with the base towards the rear.

Figure 4:
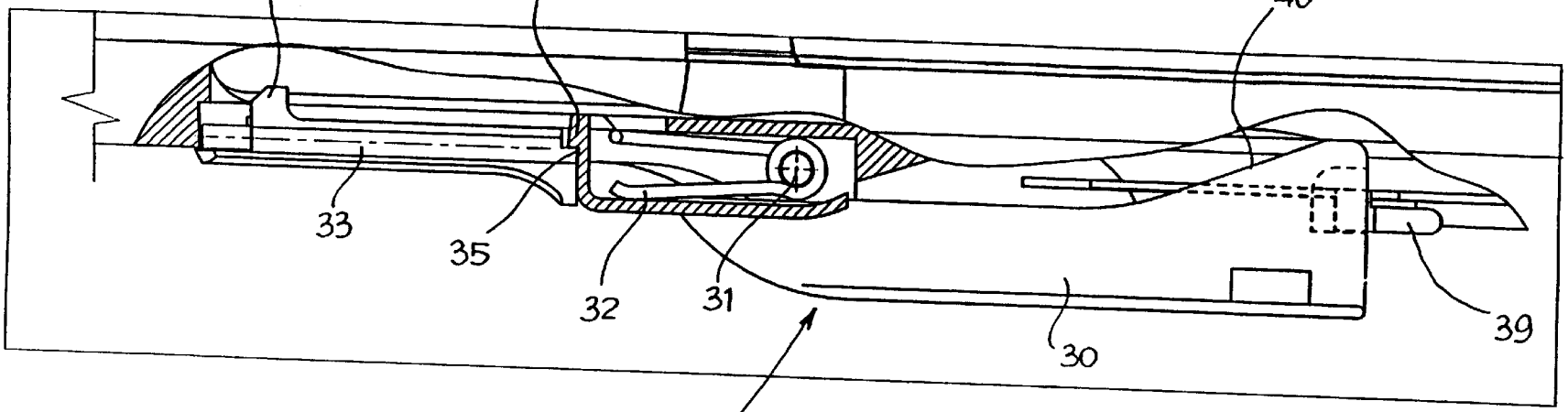
FIG. 4 is an enlarged view of the part of the rifle defined by the section B in FIG. 2.

A spring 32, which is mounted on the rotating pin 31 and is prestressed between the spoon and casing, tends to make the spoon 30 rotate from the starting position to the feeding position (FIG. 4).

Figure 11:
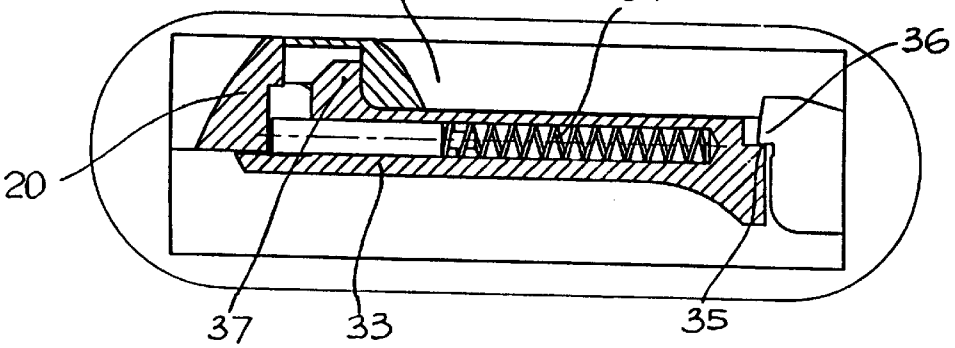
FIG. 11 is an enlarged detail of a part D encircled in FIG. 10.

On the other hand, precisely in its rear part, the spoon 30 interacts with a stop slide 33 to lock the spoon in its starting position against the action of the spring 32 and to unlock the spoon when this spoon 30 must be moved into the feeding position. The stop slide 33 is guided in the casing 20 in parallel with the breechblock 22. It is stressed by a hook spring 34, which usually keeps it pressed towards the spoon 30 (FIG. 11).

On the one hand, in front, the slide 33 has a catch 35 intended to intercept a lug 36 in the rear of the spoon 30 in the manner of holding this spoon 30 in the starting position, the interaction of the catch with the lug of the spoon being ensured by the hook spring 34. On the other hand, in the rear, the slide 33 has a release lip 37 intended to be intercepted by the breechblock unit 22 only when same has stopped.

The action of the breechblock unit against the release lip 37 thus causes a stopping of the stop slide 33 and consequently the release of the spoon 30 by the catch 35 so that this spoon 30, moved by the spring 31, is moved into the feeding position. Then, with its subsequent advancement, the breechblock carriage 22 picks up the second cartridge from the spoon and sends it into the cartridge chamber of the barrel.

Figure 3:
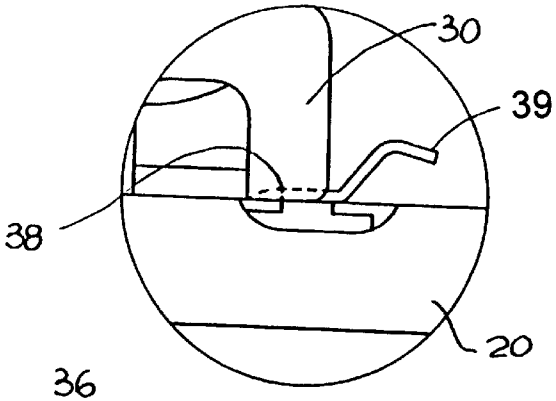
FIG. 3 is an enlarged view of a part A encircled in FIG. 1.
Figures 6, 7:
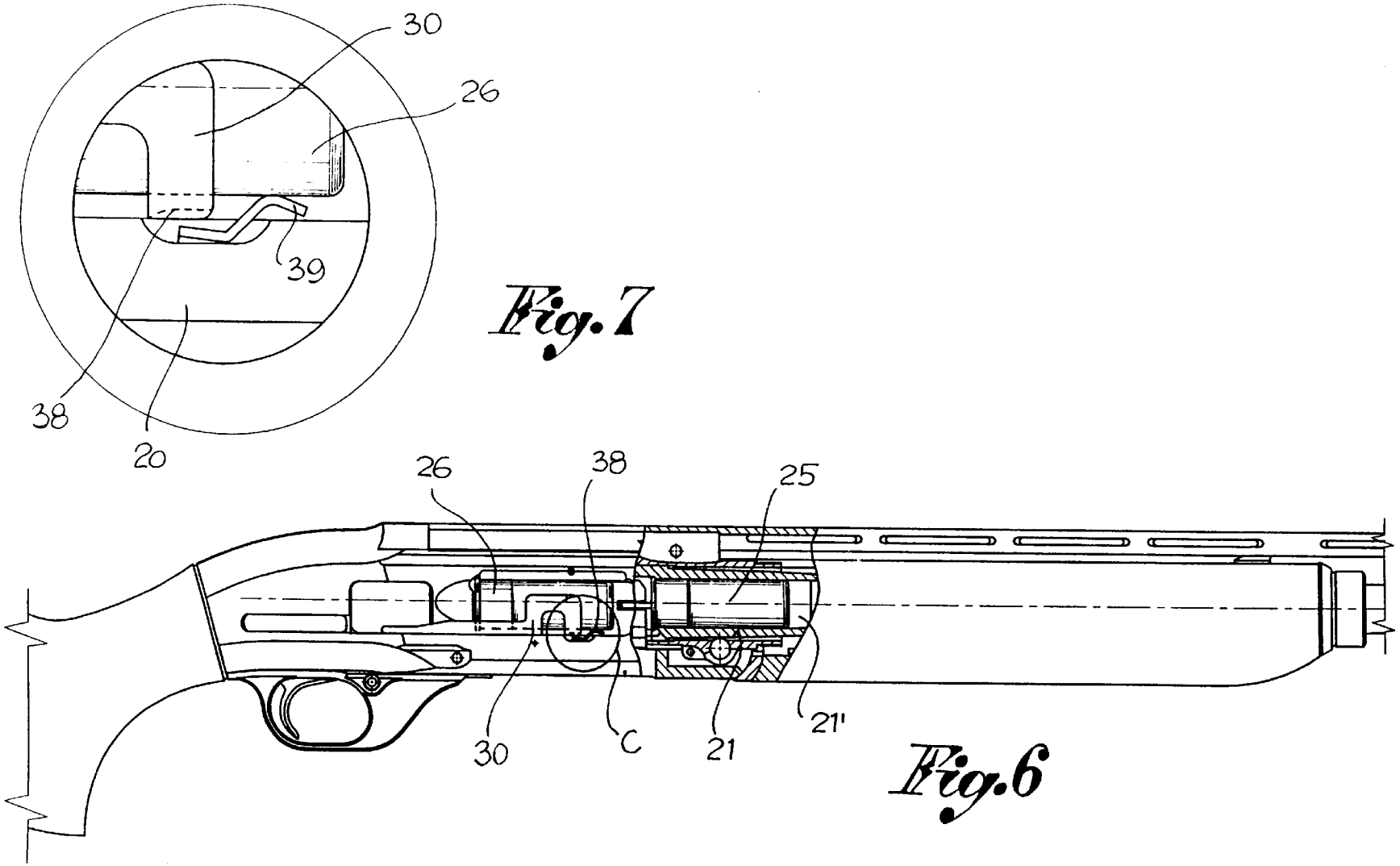
FIG. 6 is a section of the gun with a cartridge in the barrel and one on the feeding means.
FIG. 7 is an enlarged detail of a part C encircled in FIG. 6.

In addition, in its front part, the spoon 30 has a cavity 38 (FIGS. 3, 4 and 7), in which engages a consent lever 39, which acts as a means of enabling the release of the spoon for its movement from the starting position to the feeding position only if the second cartridge 26 is present on the spoon 30 (FIG. 7). In fact, only the second cartridge on the spoon presses the consent lever 39, disengaging it from the cavity 38 of the spoon 30 so that this spoon 30 may rotate towards the interior of the casing.

Finally, towards the interior of the casing, the spoon 30 has a cam-shaped wing 40, which interferes with the breechblock when same advances so as to cause the return of the spoon into the starting position after the second cartridge is fed in, where it shall be hooked onto by the slide 33.

Figure 5:
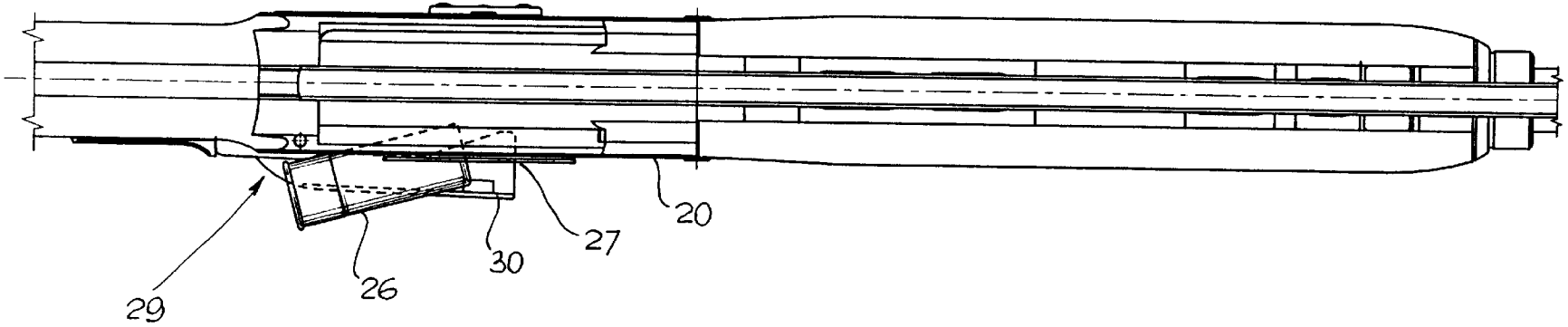
FIG. 5 is part of the gun in the phase of introducing a cartridge into the feeding means.

FIGS. 1–4 show the gun with the spoon 30 in its starting position, but without the second cartridge 26. FIG. 5 shows the phase of insertion of the second cartridge 26 into the feeding means, or on the spoon 30, assuming that the first cartridge 25 is already in the cartridge chamber 21' and that the breechblock is advanced in the closed position as in FIG. 6. The cartridge 26 on the spoon 30 releases the consent lever 39 as in FIG. 7 in order to enable the rotation of the spoon from the starting position.

After the firing of the first cartridge 25, the breechblock 22 stops, and the case 25' is removed with the corresponding removal means 22'.

Figure 8:
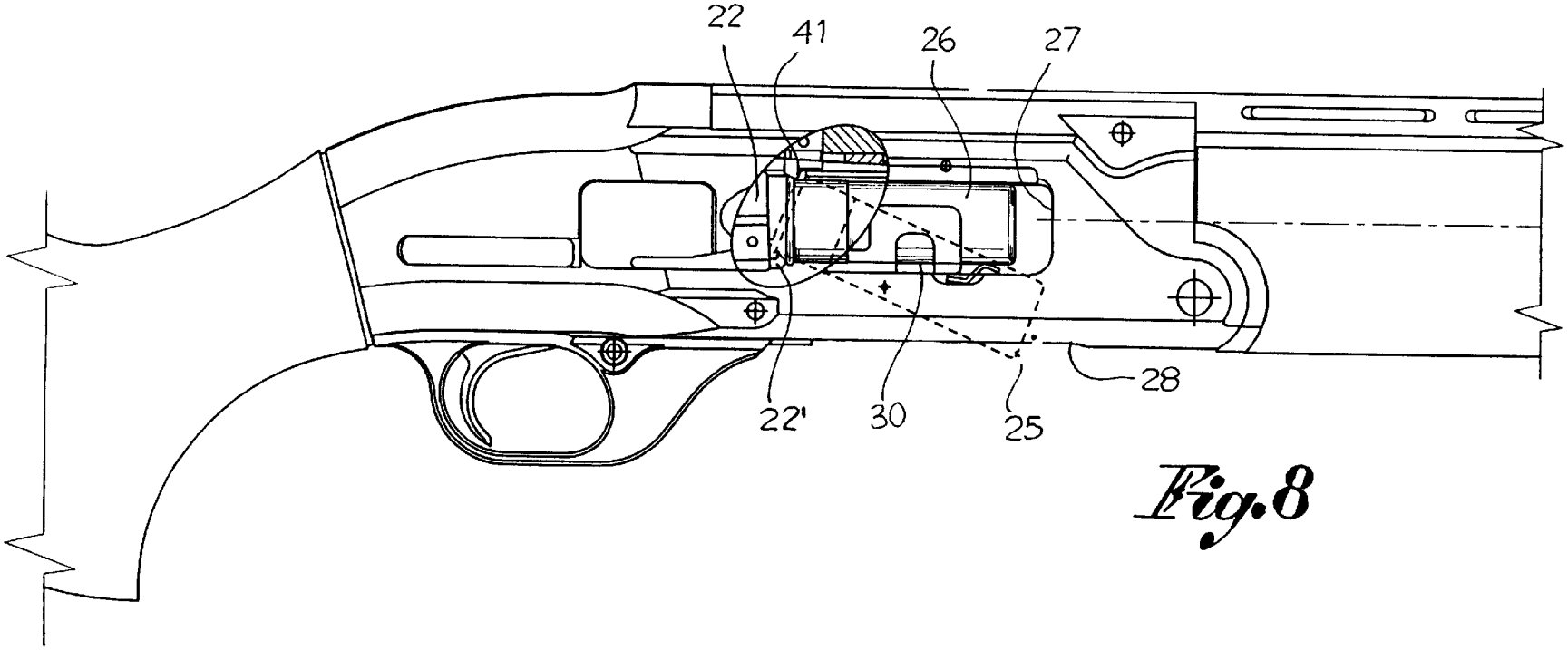
FIG. 8 is the phase of removal and ejection from below of the case of a fired cartridge.
Figure 9:
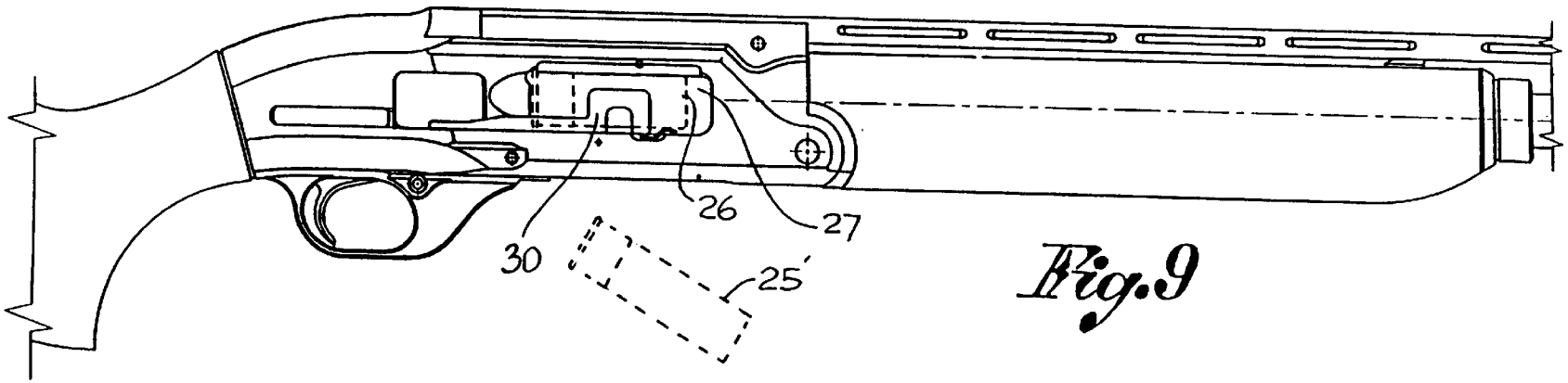
FIG. 9 is a lateral view of the gun in the position of releasing the feeding means from the breechblock unit.
Figure 10:
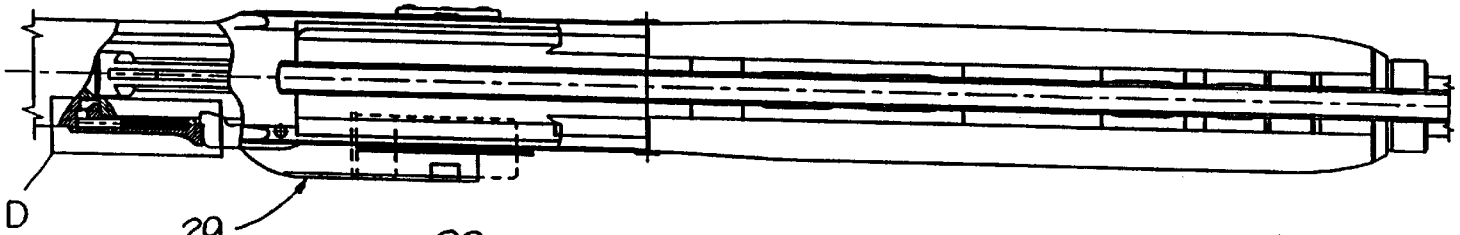
FIG. 10 is a top view of the gun in the position of releasing the feeding means from the breechblock unit.

The case, stopping with the breechblock, meets an ejection shoulder 41, which forces it to slope and to exit from the lower opening 28 of the casing as shown in FIGS. 8 and 9. At the same time, the breechblock, stopping (FIGS. 10 and 11), moves the stop slide 33 backwards, thus releasing the spoon 30.

Figure 12:
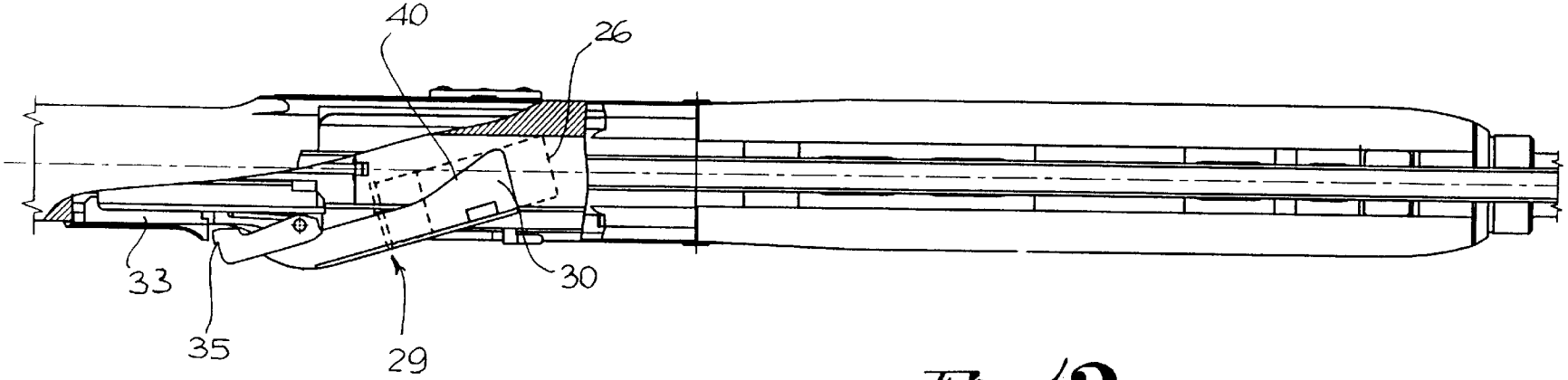
FIG. 12 is a partial section of the gun with the feeding means in the phase of introducing the cartridge into the casing.

This spoon 30, stressed by the corresponding spring 32, rotates towards the interior with the second cartridge turned towards the cartridge chamber of the barrel as in FIG. 12.

Figure 13:
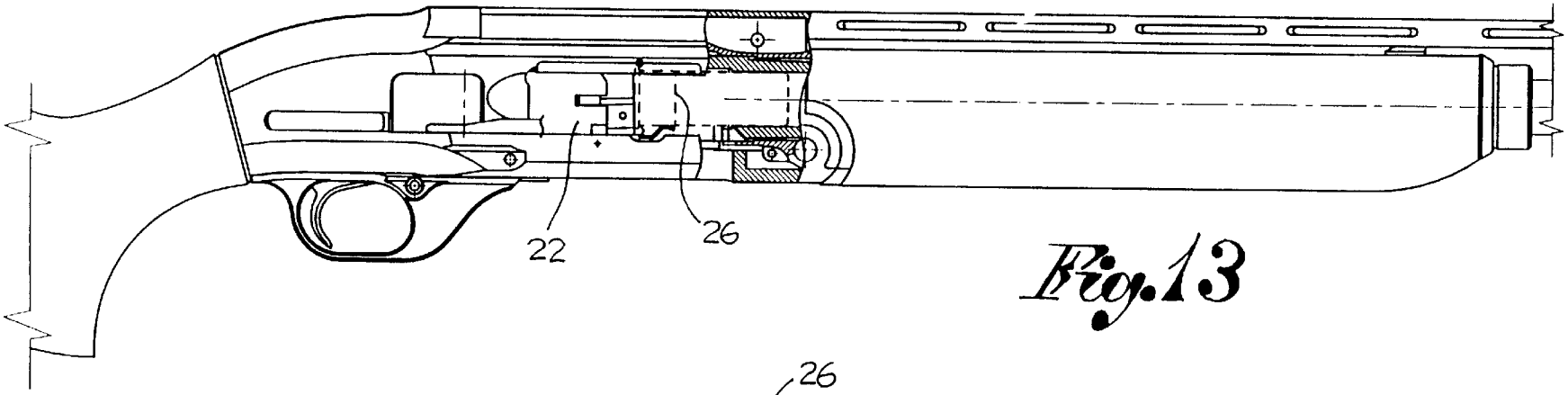
FIG. 13 is a lateral view of a partial section of the gun in the position of inserting the cartridge into the chamber from the breechblock.
Figure 14:
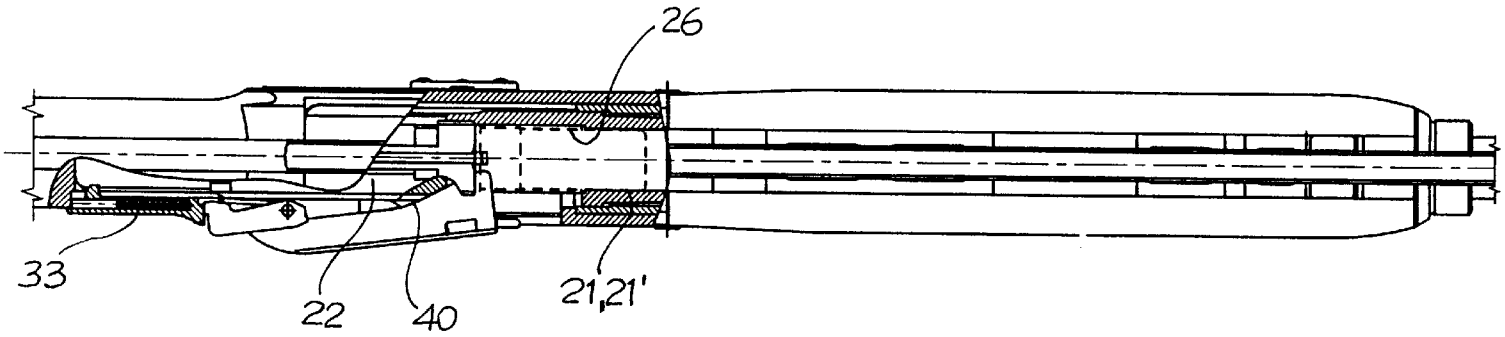
FIG. 14 is a lateral view of a partial section of the gun in the position of inserting the cartridge into the chamber from the breechblock.
Figure 15:
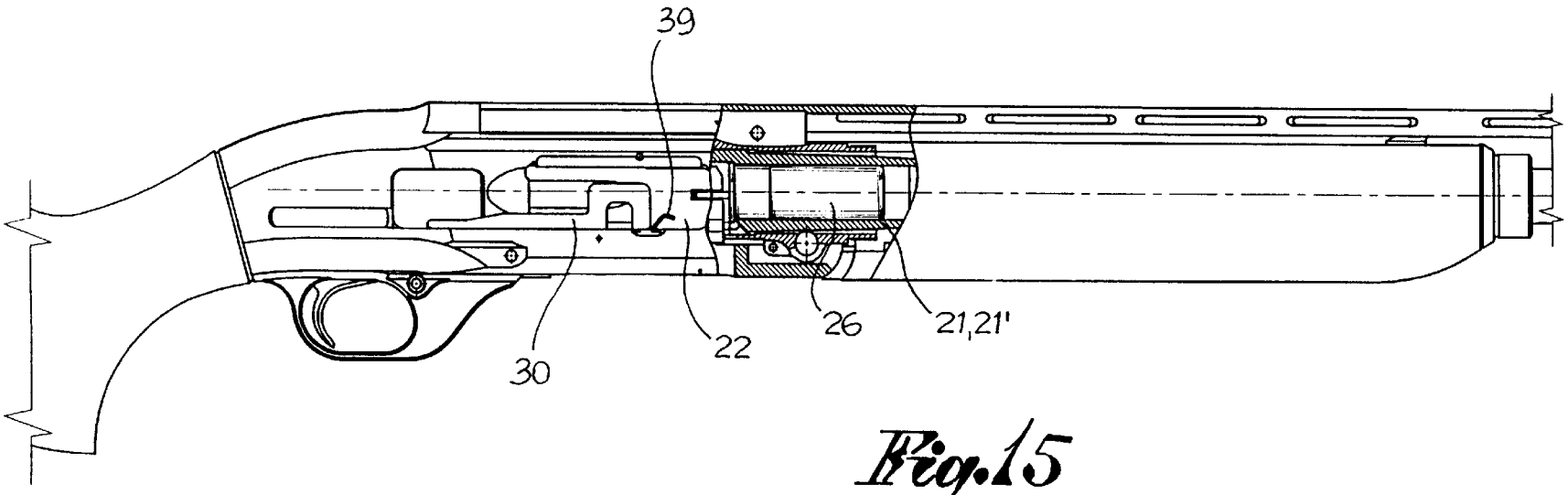
FIG. 15 is a partial sectional view of the gun with the feeding means empty and with the second cartridge in the barrel for firing.

At this point, the breechblock advances, intercepts, and pushes the second cartridge 26 into the chamber 21', and while simultaneously interacting with the cam wing 40 (FIGS. 13 and 14) brings the spoon out into its starting position. The second cartridge 26, pushed into the chamber by the breechblock, may then be fired, while the feeding means remains empty on the side of the casing.

While a specific embodiment of the invention has been shown and described in detail to illustrate the application of the principles of the invention, it will be understood that the invention may be embodied otherwise without departing from such principles.

What is claimed is:

1. A semiautomatic sports rifle or shotgun having a smooth or rifled bore, comprising:

a casing having a lateral opening for introducing cartridges on one side of said casing and a lower opening for ejecting from below the case of each cartridge fired;

a barrel connected to said casing, said barrel having a cartridge chamber;

a breechblock unit which can be moved in said casing between an advanced position and a stopped position corresponding to positions of closing and of opening of the said cartridge chamber, respectively;

a triggering device for controlling the firing;

a lateral feeding means mounted substantially at the level of said lateral opening of said casing, said feeding means for receiving and holding a second cartridge during a firing of a first cartridge and to introduce the second cartridge into the gun automatically with the aid of said breechblock unit after the firing of the first cartridge ejecting the empty case through the lower opening in said casing and following the backwards movement of said breechblock, said lateral feeding means comprises a spoon element which is mounted on a pin that rotates with a vertical axis, said spoon element being directed towards a rear from the said rotating pin, said spoon element being shaped to receive the cartridge with its base turned towards the rear and being movable between a starting position outside the casing, in which it receives and holds said second cartridge, and an internal feeding position, in which it is turned diagonally within said casing, towards the cartridge chamber through said lateral opening and with the base of the cartridge in the position of being intercepted by the breechblock unit when it moves into the advanced position to introduce the second cartridge into the chamber of the barrel.

2. The semiautomatic rifle in accordance with claim 1, wherein said spoon element is stressed by a prestressed spring, which tends to make the spoon element rotate from the outside starting position to the internal feeding position and in which are provided a stop means for defining and holding the spoon element in said starting position against the action of said spring, a means for enabling the movement of the said spring towards the feeding position only with the presence of the second cartridge on the feeding means, and a release means, which interacts with the breechblock unit, which stops to disconnect said stop means that hold said spoon element in the stating position, so that said spoon element moves in the feeding position.

3. The semiautomatic rifle in accordance with claim 2, wherein said stop means and said release means are integrated into a slide, arranged on the side of said casing, in parallel with the said breechblock unit and turned towards said spoon element from the rear forwards.

4. The semiautomatic rifle in accordance with claim 2, wherein said means for enabling the movement of said spoon element only in the presence of the second cartridge is a consent lever, which usually engages in a cavity of said spoon element in order to hold said spoon element in the starting position and which is disengaged from said cavity if the feeding means is loaded with said cartridge.

5. The semiautomatic rifle in accordance with claim 2, wherein said spoon element has a cam-shaped wing, which is intended to interact with said breechblock unit advancing for a return of said spoon element from the feeding position to the starting position, in which it is automatically engaged by said stop means.

6. The semiautomatic rifle in accordance with claim 1, wherein said casing includes an ejection shoulder, which intercepts the cartridge case dragged by the stopping said breechblock unit in order to force the cartridge to exit from the lower opening.

7. A semiautomatic sports rifle having a smooth or rifled bore, comprising:

a casing having a lateral opening for introducing cartridges on one side of said casing and a lower opening for ejecting from below the case of each cartridge fired;

a barrel connected to said casing, said barrel having a cartridge chamber;

a breechblock unit which can be moved in said casing between an advanced position and a stopped position corresponding to positions of closing and of opening of the said cartridge chamber, respectively;

a triggering device for controlling the firing;

a lateral feeding means mounted substantially at the level of said lateral opening of said casing, said feeding means for receiving and holding a second cartridge during a firing of a first cartridge and to introduce the second cartridge into the gun automatically with the aid of said breechblock unit after the firing of the first cartridge ejecting the empty case through the lower opening in said casing and following the backwards movement of said breechblock, said lateral feeding means comprises a spoon which is mounted on a pin that rotates with a vertical axis, said spoon being directed towards a rear from the said rotating pin, said spoon being shaped to receive the cartridge with its base turned towards the rear and being movable between a starting position outside the casing, in which it receives and holds said second cartridge, and an internal feeding position, in which it is turned diagonally within said casing, towards the cartridge chamber through said lateral opening and with the base of the cartridge in the position of being intercepted by the breechblock unit when it moves into the advanced position to introduce the second cartridge into the chamber of the barrel.

8. The semiautomatic rifle in accordance with claim 7, wherein said spoon is stressed by a prestressed spring, which tends to make the spoon rotate from the outside staring position to the internal feeding position and in which are provided a stop means for defining and holding the spoon in said starting position against the action of said spring, a means for enabling the movement of the said spring towards the feeding position only with the presence of the second cartridge on the feeding means, and a release means, which interacts with the breechblock unit, which stops to disconnect said stop means that hold said spoon in the starting position, so that said spoon moves in the feeding position.

9. The semiautomatic rifle in accordance with claim 8, wherein said stop means and said release means are integrated into a slide, arranged on the side of said casing, in parallel with the said breechblock unit and turned towards said spoon from the rear forwards.

10. The semiautomatic rifle in accordance with claim 8, wherein said means for enabling the movement of said spoon only in th e presence of the second cartridge is a consent lever, which usually engages in a cavity of said spoon in order to hold said spoon in the starting position and which is disengaged from said cavity if the feeding means is loaded with said cartridge.

11. The semiautomatic rifle in accordance with claim 8, wherein said spoon has a cam-shaped wing, which is intended to interact with said breechblock unit advancing for a return of said spoon from the feeding position to the starting position, in which it is automatically engaged by said stop means.

12. The semiautomatic rifle in accordance with claim 7, wherein said casing includes an ejection shoulder, which intercepts the cartridge case dragged by the stopping said breechblock unit in order to force the cartridge to exit from the lower opening.

13. A shotgun having a smooth or rifled bore, comprising:

a casing having a lateral opening for introducing cartridges on one side of said casing and a lower opening for ejecting from below the case of each cartridge fired;

a barrel connected to said casing, said barrel having a cartridge chamber;

a breechblock unit which can be moved in said casing between an advanced position and a stopped position corresponding to positions of closing and of opening of the said cartridge chamber, respectively;

a triggering device for controlling the firing;

a lateral feeding means mounted substantially at the level of said lateral opening of said casing, said feeding means for receiving and holding a second cartridge during a firing of a first cartridge and to introduce the second cartridge into the gun automatically with the aid of said breechblock unit after the firing of the first cartridge ejecting the empty case through the lower opening in said casing and following the backwards movement of said breechblock, said lateral feeding means comprises a spoon which is mounted on a pin that rotates with a vertical axis, said spoon being directed towards a rear from the said rotating pin, said spoon being shaped to receive the cartridge with its base turned towards the rear and being movable between a starting position outside the casing, in which it receives and holds said second cartridge, and an internal feeding position, in which it is turned diagonally within said casing, towards the cartridge chamber through said lateral opening and with the base of the cartridge in the position of being intercepted by the breechblock unit when it moves into the advanced position to introduce the second cartridge into the chamber of the barrel.

14. The shotgun in accordance with claim 13, wherein said spoon is stressed by a prestressed spring, which tends to make the spoon rotate from the outside starting position to the internal feeding position and in which are provided a stop means for defining and holding the spoon in said staring position against the action of said spring, a means for enabling the movement of the said spring towards the feeding position only with the presence of the second cartridge on the feeding means, and a release means, which interacts with the breechblock unit, which stops to disconnect said stop means that hold said spoon in the starting position, so that said spoon moves in the feeding position.

15. The shotgun in accordance with claim 14, wherein said means for enabling the movement of said spoon only in the presence of the second cartridge is a consent lever, which usually engages in a cavity of said spoon in order to hold said spoon in the starting position and which is disengaged from said cavity if the feeding means is loaded with said cartridge.

16. The shotgun in accordance with claim 14, wherein said spoon has a cam-shaped wing, which is intended to interact with said breechblock unit advancing for a return of said spoon from the feeding position to the starting position, in which it is automatically engaged by said stop means.

17. The shotgun in accordance with claim 13, wherein said casing includes an ejection shoulder, which intercepts the cartridge case dragged by the stopping said breechblock unit in order to force the cartridge to exit from the lower opening.

* * * * *